United States Patent [19]

Hanyu et al.

[11] Patent Number: 4,580,514

[45] Date of Patent: Apr. 8, 1986

[54] MULTIPLE HEM STITCHES AND APPARATUS FOR FORMING THE SAME

[75] Inventors: Susumu Hanyu, Tokyo; Reishi Nomoto, Kanagawa, both of Japan

[73] Assignee: Janome Sewing Machine Industry Co., Ltd., Japan

[21] Appl. No.: 586,486

[22] Filed: Mar. 5, 1984

[30] Foreign Application Priority Data

Mar. 4, 1983 [JP] Japan ..... 58-34374

[51] Int. Cl.[4] ..... D05B 1/10; D05B 1/22; D05B 57/06

[52] U.S. Cl. ..... 112/162; 112/166; 112/199; 112/438; 112/441

[58] Field of Search ..... 112/166, 199, 268.1, 112/269.1, 433, 438, 441, 162

[56] References Cited

U.S. PATENT DOCUMENTS

| | | | |
|---|---|---|---|
| 1,640,201 | 8/1927 | Maier | 112/199 X |
| 2,248,907 | 7/1941 | Lutz | 112/433 |
| 3,126,850 | 3/1964 | Sigoda | 112/199 X |
| 3,145,672 | 8/1964 | Marforio | 112/199 X |
| 4,117,792 | 10/1978 | Navlyt | 112/433 |

*Primary Examiner*—Wm. Carter Reynolds
*Attorney, Agent, or Firm*—William A. Drucker

[57] ABSTRACT

Multiple hem stitches are produced for joining a plurality of superimposed fabric materials along their edges by employing a sewing machine having a pair of vertically reciprocating needles each carrying a needle thread and a pair of loopers each carrying a looper thread. The first and second needle threads extend along the fabric edge and in parallel with each other on the upper face of the fabrics and penetrate through the fabrics to form a first and second needle thread loops on the underside of the fabrics. The first needle thread loop is distended laterally to the fabric edge by the first looper. The first looper thread encompasses the first needle thread at each penetration point and extends laterally on the upper face of the fabrics to form a first looper thread loop which is caught by the descending first needle to be interlocked with the first needle thread loop along the fabric edge. The second looper thread extends on the underside of the fabrics beneath the second needle thread and pierces the second needle thread loop to form a second looper thread loop which is looped about the first needle thread at each penetration point.

1 Claim, 5 Drawing Figures

MULTIPLE HEM STITCHES AND APPARATUS FOR FORMING THE SAME

BACKGROUND OF THE INVENTION

This invention relates to improved multiple hem stitches for sewing up two superimposed materials and an apparatus for forming the multiple hem stitches used in combination with a sewing machine.

Typical types of overedge or hem stitches may be generally referred to as Stitch Types E12A and E13 specified by the Japanese Industrial Standard (JIS). The former type stitch E12A is formed with a sewing machine having one needle carrying a needle thread and one looper carrying a looper thread. The needle is vertically reciprocated to penetrate the fabric to form a thread loop beneath the underside of the fabric inwardly of the edge thereof. The loop is caused by the looper to extend to the fabric edge transversely thereof. The looper is further moved around the fabric edge to a position above the fabric into the moving path of the needle where the descending needle will catch the looper thread to interlock the needle thread and the looper thread to thereby form a hem stitch while the needle thread is tightened and the fabric is transported one step. The latter type stitch E13 is formed with a sewing machine having one needle carrying a needle thread and two loopers carrying first and second looper thread respectively. The needle is vertically reciprocated to penetrate the fabric to form a loop on the underside of the fabric. Then the first looper is operated to catch the loop of the needle thread. At the same time, the second looper is operated to catch the looper thread of the first looper. The second looper is further moved around the fabric edge into the moving path of the needle above the fabric, where the descending needle catches the second looper thread. Thus a specific hem stitch is formed with three threads properly interlocked to each other. However, both types of such conventional hem stitches may be satisfactory for simply hemming the fabric, but is not satisfactory for giving the effect of sewing up two or more of superimposed fabric beside hemming the same.

These hem stitches E12A and E13 can be more reinforced with an additional stitch for sewing up two or more fabrics besides simply hemming the same. Such an additional stitch may be the Stitch Type D12 of JIS comprising a needle thread and a looper thread interlocked with each other into a double-chain stitch. Such a reinforced type of the stitch (D12+E12A) may be formed by employing a pair of needles each carrying a needle thread and a pair of loopers each carrying a looper thread, or another reinforced type stitch (D12+E13) may be formed by employing a pair of needles and three loopers, and can be advantageously used for sewing up two or more superimposed fabrics hemming the edges thereof, and at the same time has sufficient stretch or elasticity in the seam. Moreover, the reinforced stitch will not be easily loosened even when a portion of the stitch is accidentally cut off. However, in a looper mechanism of a sewing machine adapted to form such reinforced stitches, there must be provided not only drive means for one or two loopers for forming the hem stitch portion E12A or E13 but also another independent driveC means for a looper for forming the double-chain stitch portion D12 which must be so designed as to prevent the looper from contacting the vertically reciprocating needle, resulting in a great probability of complicating the looper mechanism, and impeding the manufacturing cost reduction purpose. Thus, the hem stitch sewing machine manufactured with special intent to produce such reinforced stitches has, in practice, a limited application of use, that is usable for industrial purposes but is not suitable for domestic use irrespective of recently increasing demand therefor.

SUMMARY OF THE INVENTION

In view of the foregoing, it is a primary object of the present invention to provide hem stitches which will sew up two or more superimposed fabrics besides hemming the same, and their edges positioned in vertical alignment, which will have excellent stitch strength and elasticity comparable with those of conventional reinforced stitch described above.

It is another object of the invention is to provide hem stitches having an improved stability and resistance against thread cut-off troubles, that is having a lesser probability of the seam to be loosened.

It is yet another object of the invention to provide an improved hem stitch sewing machine capable of sewing up two or more superimposed fabrics besides hemming the same with an improved strength of stitches.

It is still another object of the invention to provide a hem stitch sewing machine applicable for domestic use in a wide variation of use.

According to one aspect of the invention there are provided multiple hem stitches continuously produced to sew up a plurality of superimposed fabrics along edges thereof comprising: first straight stitches formed on the fabric along and inwardly of the edges thereof, each extended toward and transversely of the edges of the fabrics on the underside thereof; first looper stitches extended transversely of the edges of the fabrics on the upper side thereof between the first straight stitches and the transversely extended parts thereof, each having one end interlocked with each of the first straight stitches and the other end interlocked with each of the transversely extended parts of the first straight stitches at the edges of the fabrics; second straight stitches formed in parallel with the first straight stitches further inwardly of the edges of the fabrics; and second looper stitches provided along and inwardly of the edges of the fabrics on the underside thereof and each including a loop extended laterally of the edges of the fabrics, the loop having one end interlocked with each of the second straight stitches and the other end interlocked with each of the transversely extended parts of the first straight stitches on the underside of the fabric.

According to another aspect of the invention there is provided a sewing machine for continuously producing multiple hem stitches to sew up the superimposed edges of a plurality of fabrics comprising: a first needle carrying a first needle thread and vertically reciprocated to penetrate the fabrics inwardly of the edges thereof to form a first loop on the underside of the fabrics; a first looper carrying a first looper thread and operated to move along a predetermined path around the edges of the fabrics between a position below the fabrics in which the looper catches the loop of the first needle thread and a position above the fabric in which the first looper thread is caught by the first needle as the latter descends; a second needle carrying a second needle thread and vertically reciprocated in synchronism with the first needle to penetrate the fabrics further inwardly of the edges thereof to form a second loop on the underside of the fabrics; and a second looper carrying a second looper thread and reciprocatingly moved between an inoperative position and an operative position in which the second looper catches the loop of the second needle thread to provide a new loop formed with the second looper thread and the loop of the second needle thread as the fabrics are transported one step in one direction, the new loop being caught by the first needle as the latter descends.

BRIEF DESCRIPTION OF DRAWINGS

Further objects and advantages of the invention can be fully understood from the following detailed description when read in conjunction with the accompanying drawings in which:

FIGS. 4 through 8 are diagrammatic perspective views showing the successive steps in the formation of the multiple hem stitches shown in FIGS. 1 and 2.

PREFERRED EMBODIMENTS OF THE INVENTION

Figure 1:
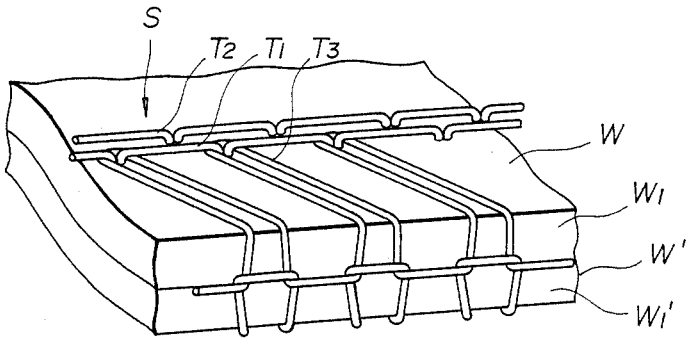
FIG. 1 is a diagrammatic perspective view showing the multiple hem stitches embodying the invention which will sew up two superimposed fabrics, as viewed from the upper side thereof.

A preferred embodiment of the invention is hereunder described while referring to the drawings in which identical reference numerals indicates identical elements or portions throughout the several views.

Figure 2:
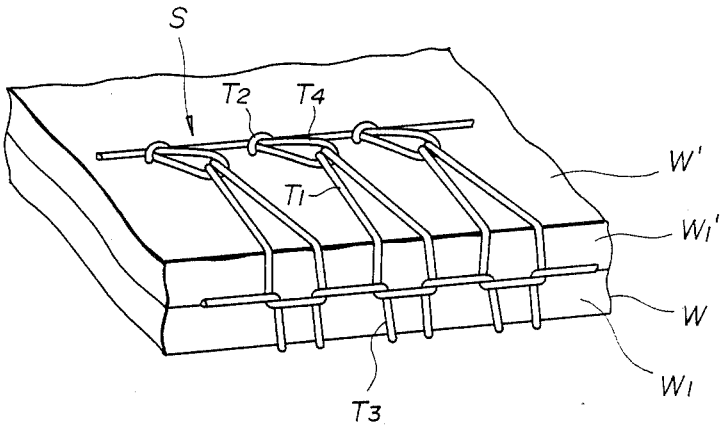
FIG. 2 is a diagrammatic perpsective view showing the multiple hem stitches shown in FIG. 1, as viewed from the bottom side of the fabrics.

As is best shown in FIGS. 1 and 2, the multiple hem stitches of the invention S which sews up two superimposed workpieces W and W' includes the aforesaid stitch type E12A composed of a needle thread $T_1$ and a looper thread $T_3$ interlocked with each other, and extending across the superimposed edges $W_1$ and $W_1'$ of the fabrics W and W'. The stitch S further includes the stitches of a second needle thread $T_2$ extending substantially adjacent and in parallel with the stitches of the first needle thread $T_1$ on the upper face of the fabric W and forming a thread loop on the underside of the lower fabric W', and the stiches on a second looper thread $T_4$ extending laterally of the stitches $T_2$ on the underside of the fabric W' and interlocked with the stitches $T_1$ which are each extended between the stitches $T_2$ and $T_3$ as shown in FIG. 2.

Figure 3:
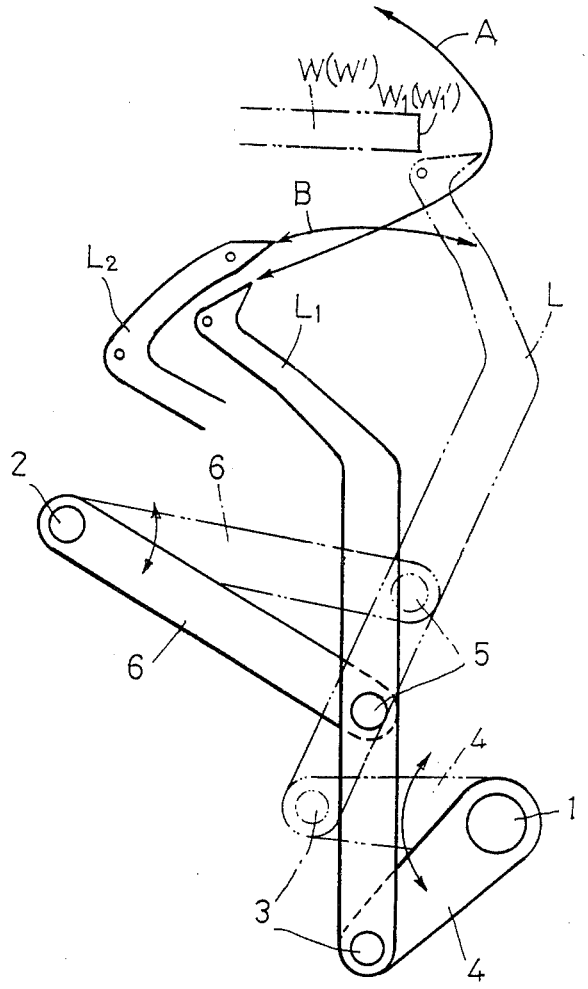
FIG. 3 is a diagrammatic view showing a looper mechanism of a sewing machine and movements thereof for producing the multiple hem stitches of the invention.
Figure 4:
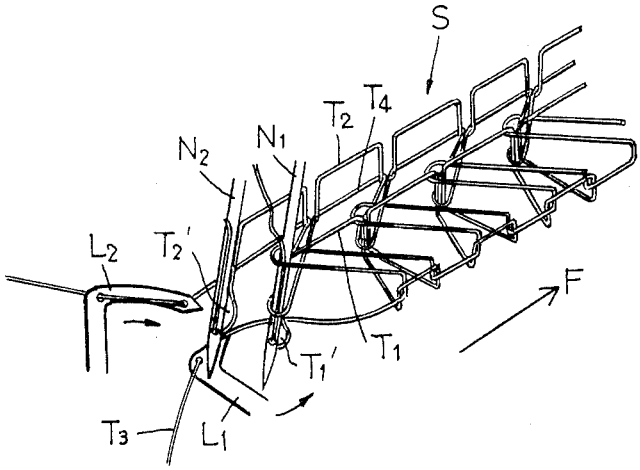

As best seen in FIGS. 3 and 4, the stitch forming mechanism used in combination with a sewing machine in the formation of the multiple hem stitches shown in FIGS. 1 and 2, includes a vertically reciprocating first needle $N_1$ carrying a first needle thread $T_1$, a second needle $N_2$ carrying a second needle thread $T_2$ vertically reciprocated in synchronism with the first needle $N_1$, a first looper $L_1$ carrying a first looper thread $T_3$ and a second looper $L_2$ carrying a second looper thread $T_4$. The second needle $N_2$ is positioned laterally spaced from the first needle $N_1$ and is also positioned just forwardly of the first needle $N_1$ in the feeding direction, namely the second needle $N_2$ is nearer to the operator. The first and second loopers $L_1$ and $L_2$ are given different and independent reciprocatory movements, and more particularly the first looper $L_1$ is moved in a plane transversely of the fabric feeding direction with its thread engaging beak describing an arcuate path of travel A wherein it begins to move from its lowermost position below the fabrics W,W' to its extreme position toward the right (as viewed in FIG. 3) whereat it goes around the side edges of the fabrics $W_1$,$W_1'$ and then moves upwardly to the left to reach the uppermost position situated above the fabric W, whereas the second looper $L_2$ simply swings below the fabrics W,W' in another plane transversely of the fabric feeding direction F within a limited amplitude B.

These reciprocatory movements of the first and second loopers $L_1$ and $L_2$ can be generally established by means of a linkage, one example of which is shown in FIG. 3 with respect to the first looper $L_1$. More particularly, the first looper $L_1$ is provided with pivot axes 3 and 5 positioned at the end and intermediate portions thereof, the former pivot axis 3 being connected to one end of a link 4 having the other end pivoted to a stationary axis 1 and the latter pivot axis 5 being connected to one end of another link 6 having the other end pivoted to a stationary axis 2, as shown.

FIGS. 4 through 8 illustrate the successive steps as well as the operation of the stitch forming mechanism in the formation of the multiple hem stitches in accordance with the invention, with some stitches having been formed in the fabric. The main drive shaft of a sewing machine (not shown) is hereby defined to have the angular position of 0° when the first and second needles $N_1$ and $N_2$ occupy their upper dead points.

Figure 5:
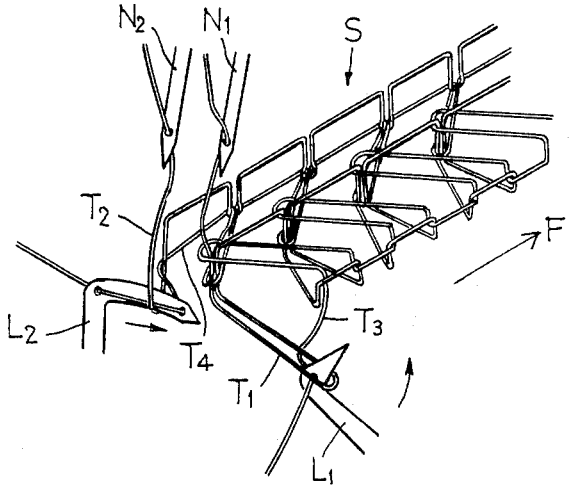

Referring now to FIG. 4 showing the stage at the phase of main drive shaft of 230°, both needles $N_1$ and $N_2$ just begin to move up from the lower dead point thereof. As the needles $N_1$ and $N_2$ go up as shown in FIG. 5 the first and second loops $T_1'$ and $T_2'$ are fomed beside the respective needles below the fabric W'. Then, the first looper $L_1$ carrying the first looper thread $T_3$ is operated to catch the first loop $T_1'$ of the needle $N_1$ and at the same time the second looper $L_2$ carrying the second looper thread $T_4$ is operated to come into the second loop $T_2'$ of the needle $N_2$. The first looper $L_1$ is moved upwardly and at the angular position 290° of main drive shaft is moved around the superposed side edges $W_1$,W of the fabrics W,W' as shown in FIG. 3. In FIG. 6, the first looper $L_1$ still carrying the first thread loop $T_1'$ is further advanced to reach its highest position above the fabric W at the angular position 0° of main drive shaft, and then the beak portion thereof will enter the path of travel of the first needle $N_1$. In the meantime the first needle $N_1$ comes down and passes through the first looper thread $T_3$ of the first looper $L_1$, and at the same time the first looper $L_1$ starts to retire in the rightward direction while still catching the first needle thread loop $T_1'$, as shown in FIGS. 6 and 7. Thus the first looper thread $T_3$ is interlocked with the first needle thread $T_1$ on the upper side of the fabric W.

In the meantime, as shown in FIG. 6, the second looper $L_2$ continues its advancement to the right in the second thread loop $T_2'$ of the second needle $N_2$, and at the angular position 0° of main drive shaft starts to move back to the left. During this retiring movement of the second looper $L_2$ the fabric is transported one step in the direction F, and therefore a triangle is formed with the second needle thread $T_2$ and the second looper thread $T_4$. The descending first needle $N_1$ will penetrate the fabrics W,W' and at the angular position 100° of main drive shaft, enters the triangle below the fabric W' as shown in FIG. 7.

With the further retirement of the first looper $L_1$, the thread loop $T_1'$ of the first needle thread $T_1$ carried by the beak portion of the first looper $L_1$ is released therefrom and interlocked with the first looper thread $T_3$ at the superposed fabric edges $W_1$, $W_1'$. On the other hand, the second looper $L_2$ is moved back out of the thread loop $T_2'$ of the second needle thread $T_2$, as shown in FIG. 8. Thus the second looper thread $T_4$ is interlocked with the second needle thread $T_2$. Meanwhile, the first looper $L_1$ has come to below the fabric W' to catch the loop $T_1'$ of the first needle $N_1$ which is in the triangle formed with the second needle thread $T_2$ and the second looper thread $T_4$ on the underside of the fabric W' as shown in FIGS. 4, 7 and 8. Thus, the loop $T_1'$ is interlocked with the second looper thread $T_4$ on the underside of the fabric W'. Then the first and second needles $N_1$ and $N_2$ are moved up while the first and second needle threads $T_1$ and $T_2$ are drawn up by the thread take-up level (not shown) of the sewing machine and tightened together with the first and second looper threads $T_3$ and $T_4$. With the repeated cooperation of the first and second needles and first and second loopers each carrying a thread, the stitches are successively formed as shown in FIGS. 1 and 2.

The multiple hem stitches completed in the abovedescribed manner include a pair of needle threads $T_1$ and $T_2$ adjacently extending in parallel and penetrating the entire thickness of superimposed workpieces to fully obtain the stitch strength required for sewing up two or more of superimposed workpieces, that is comparable with that of the conventional reinforced types of the stitches. Moreover, the second looper thread $T_4$ of the invention lies on the underside of the fabric and is interlocked with the needle threads $T_1$ and $T_2$, as shown in FIG. 2, resulting in a lesser probability of the stitches to be loosened.

A sewing machine used for forming the hem stitches in accordance with the invention includes a pair of thread carrying needles $N_1$ an $N_2$, but the second needles $N_2$ may be removed for producing the conventional stitch type E12A of JIS. Thus, the sewing machine of this invention is usable for wide variations. In addition, the sewing machine is provided with a simplified stitching mechanism and suitable for domestic use. While the invention has been described in conjunction with a specific embodiment thereof, it is to be understood that many different modifications and variations may be made without departing from the spirit and scope thereof.

What is claimed is:

1. A sewing machine for producing multiple hem stitches to sew up superimposed edges of a plurality of fabrics comprising:

(a) a first needle $N_1$ carrying a first needle thread $T_1$ and vertically reciprocated to penetrate the fabrics to form first straight stitches along the edges of the fabrics;

(b) a first looper $L_1$ carrying a first looper thread $T_3$ and operated to move along a predetermined path substantially around the edges of the fabrics between a position below the fabrics in which said first looper catches a first needle thread loop $T_1$, formed on the underside of the fabrics as said first needle $N_1$ ascends, and a position above the fabrics in which said first looper thread $T_3$ is caught by said first needle $N_1$ as said first needle descends;

(c) a second needle $N_2$ carrying a second needle thread $T_2$ and vertically reciprocated in synchronism with said first needle $N_1$ to penetrate the fabrics further inwardly of the edges thereof to form second straight stitches therealong; and (d) a second looper $L_2$ carrying a second looper thread $T_4$ and reciprocatingly moved between an inoperative position and an operative position in which said second looper catches a second needle thread loop $T_2$, formed on the underside of the fabrics as said second needle $N_2$ ascends to provide a triangular loop at said second looper thread $T_4$ which is formed as the fabrics are transported one step in one direction, said triangular loop being caught by said first needle $N_1$ as said first needle descends.

* * * * *